United States Patent [19]

Poulin et al.

[11] 4,101,352

[45] Jul. 18, 1978

[54] DEFLAGRATIVE ELECTRONIC COMPONENT POTTING COMPOUND

[75] Inventors: Clyde J. Poulin, Phoenix, Ariz.; Theodore N. Bryla, Glendora, Calif.

[73] Assignee: The United States of America as represented by the Secretary of the Navy, Washington, D.C.

[21] Appl. No.: 113,705

[22] Filed: Feb. 8, 1971

[51] Int. Cl.[2] ..... C06B 45/10

[52] U.S. Cl. ..... 149/19.2; 149/2; 149/20; 149/113; 149/114

[58] Field of Search ..... 156/305; 149/19, 22, 149/44, 83, 113, 114, 2, 192, 20

[56] References Cited

U.S. PATENT DOCUMENTS

| | | | |
|---|---|---|---|
| 3,257,801 | 6/1966 | Martinez et al. | 149/19 X |
| 3,258,373 | 6/1966 | Douda | 149/44 X |
| 3,309,249 | 3/1967 | Allen | 149/2 |
| 3,394,218 | 7/1968 | Foudriat | 149/2 |
| 3,411,964 | 11/1968 | Douda | 149/19 |
| 3,507,837 | 4/1970 | Hidinger | 260/78.4 |
| 4,025,369 | 5/1977 | Price et al. | 149/2 |

*Primary Examiner*—Edward A. Miller

*Attorney, Agent, or Firm*—Richard S. Sciascia; Joseph M. St. Amand

[57] ABSTRACT

A potting compound, comprising a low viscosity and low temperature curing silicone resin, potassium perchlorate, magnesium and boron, for encapsulating electronic equipment and assemblies and which can be used for destroying the electronic components in emergency situations.

3 Claims, No Drawings

DEFLAGRATIVE ELECTRONIC COMPONENT POTTING COMPOUND

The invention herein described may be manufactured and used by or for the Government of the United States of America for governmental purposes without the payment of any royalties thereon or therefor.

This invention is related to copending U.S. patent application Ser. No. 113,749 for *Deflagrative Epoxy Foam Material,* and U.S. patent application Ser. No. 113,704 for *Deflagrative Circuit Board Material,* both filed together herewith.

The general purpose of this invention is to provide a flexible potting compound material that has the requisite electrical, chemical, mechanical and physical properties for usage as a potting compound within electronic assemblies, yet upon ignition via a discrete heat source will burn energetically, completely consume itself with minimal residual ash remaining and impart destruct action to adjacent electronic components or assemblies.

Commercial potting compound materials are available as potting components for encapsulation of electronics components, and assemblies. However, these potting compounds do not possess adequate deflagrative, destruct properties for security destruct applications.

It is an object of this invention, therefore, to provide a flexible potting compound with such electrical, chemical, mechanical, physical and deflagrative properties that may permit it to be used as a destruct donor for security destruct application of electronic components or assemblies.

Other objects and many of the attendant advantages of this invention will become readily appreciated as the same becomes better understood by reference to the following detailed description wherein:

The concept of denying knowledge of an electronic circuit to an enemy through destruction of the actual circuit by means of an extrinsic destruct donor has been employed by military establishments for a number of years. The present flexible pyrotechnic composition based on silicone resin binders for use as a flexible, deflagrative potting compound is a new and effective destruct donor providing self destruct capabilities to electronic assemblies.

A mixture of the following ingredients is a representative formulation for the flexible potting compound of this invention:

Boron (1–3 micron size): 6% by weight
Magnesium (18 micron size): 15% by weight
Potassium perchlorate (8 micron size): 39% by weight Low viscosity, low temperature curing silicone resin (such as Dow Sylgard 182): 40% by weight After thorough mixing the compound can be cured at a temperature of approximately 212° F for 1 hour. The uncured potting compound material is of such viscosity that it is easily pourable into inaccessible electronic assembly areas. The cured compound burns at a rate of 0.5 inch/second under ambient temperature and pressure conditions.

The advantages of this flexible deflagrative insulating potting compound material are that the material also possesses deflagrative and destruct properties to permit this material to be used as a potting compound in electronic components and assemblies. Upon ignition it serves as a discrete heat source for the non-catastrophic destruct action of electronic components and assemblies. The oxidizer-pyrotechnic composition and silicone resin formulation for both potting and destruct purposes is new.

The ignition of the deflagrative compound is by hot wire, pyro fuze or electric squib, accomplished by embedding or placing initiating materials such as palladium claded aluminum wire materials, flexible plastic bonded magnesium teflon compositions or lead sheathed metal-oxidant/explosive loaded cord materials into or adjacent to the deflagrative compound.

Extensive destruction of electronic components was caused when potted with a ¼ inch layer of this deflagrative compound and then ignited.

What is claimed is:

1. A deflagrative potting material for electronic assemblies which upon ignition serves as a discrete heat source for the destruction of said assemblies consisting of a mixture of:

6% by weight of 1 to 3 micron particle size boron
15% by weight of 18 micron particle size magnesium
39% by weight of 8 micron particle size potassium perchlorate, and
40% by weight of low viscosity, low temperature curing silicone resin.

2. A potting material as in claim 1 wherein the uncured mixture is of such viscosity that it is easily pourable and after being cured at a temperature of 212° F. for approximately one hour is a flexible insulating and pyrotechnic material.

3. A potting compound as in claim 1 which after being cured, when ignited will burn energetically at a rate of about 0.5 inch per second under ambient temperature and pressure conditions, will completely consume itself with minimal residual ash and impart destruct action to adjacent electronic assemblies.

* * * * *